United States Patent [19]

Collier

[11] Patent Number: 4,768,980

[45] Date of Patent: Sep. 6, 1988

[54] ELECTRICAL CONTACT

[75] Inventor: John C. Collier, Liverpool, England

[73] Assignee: BICC Public Limited Company, London, England

[21] Appl. No.: 66,341

[22] Filed: Jun. 25, 1987

Related U.S. Application Data

[63] Continuation of Ser. No. 879,362, Jun. 27, 1986, abandoned.

[30] Foreign Application Priority Data

Jul. 1, 1985 [GB] United Kingdom ..... 8516610

[51] Int. Cl.[4] ..... H01R 13/04; H01R 13/428

[52] U.S. Cl. ..... 439/751; 439/82

[58] Field of Search ..... 439/78–84, 439/733, 751, 825–827, 869, 870, 873

[56] References Cited

U.S. PATENT DOCUMENTS

| | | | |
|---|---|---|---|
| 4,017,143 | 4/1977 | Knowles | 339/221 R |
| 4,076,356 | 2/1978 | Tamburro | 339/17 C |
| 4,166,667 | 9/1979 | Griffin | 339/221 R |
| 4,183,610 | 1/1980 | Key | 339/221 R |
| 4,381,134 | 4/1983 | Anselmo et al. | 339/221 R |
| 4,415,220 | 11/1983 | Kant | 339/221 R |

FOREIGN PATENT DOCUMENTS

| | | |
|---|---|---|
| 0125098 | 11/1984 | European Pat. Off. . |
| 0138309 | 4/1985 | European Pat. Off. . |
| 1615681 | 6/1970 | Fed. Rep. of Germany . |
| 2937883 | 4/1981 | Fed. Rep. of Germany . |
| 1540623 | 2/1979 | United Kingdom . |

*Primary Examiner*—Gil Weidenfeld
*Assistant Examiner*—Gary F. Paumen
*Attorney, Agent, or Firm*—Parkhurst & Oliff

[57] ABSTRACT

An electrical press-fit contact includes a compliant section (3) of substantially C-shaped cross-section and comprising first and second arm portions (4)(5) with a base portion (8) therebetween. The thickness of the compliant section increases steadily from the base portion (8) to the arm portions (4)(5) such that the center of the base portion is of least thickness to form a hinge about which the first and second arm portions may be preferentially deflected. The contact is formed by coining a portion of stock etc such that it has a planar first surface and an arcuate second surface sloping away from the first surface towards its edges. The coined portion is then folded to form the C-shaped compliant section with the first surface being the outer surface and the second surface the inner surface thereof.

6 Claims, 1 Drawing Sheet

ELECTRICAL CONTACT

This is a Continuation of application Ser. No. 879,362, filed June 27, 1986, now abandoned.

This invention relates to electrical contacts, and particularly contacts which may be inserted into apertures in mounting boards such as printed circuit boards.

Electrical contacts having compliant sections are well-known in the art. A variety of different shaped compliant sections have all been proposed, but the most commonly used contacts are those having crescent, C-shaped compliant sections. GB No. 1540623 discloses one such C-shaped pin, having tapering arms thinning down at the extremities thereof. On insertion of the compliant section into a circular aperture, the arms of the C-shaped section are flexed inwardly in order to be accommodated within the hole, and an electrical connection is made between the contact and the plating on the sides of the aperture.

The standards of performance required of contacts such as these may vary depending on the nature of their intended use. Not only is the quality of the electrical connection of importance, but also the forces required for insertion and removal of the contacts, in holes which may vary considerably in size one from another. Additionally the performance of these contacts is required to be maintained in holes which have had contacts repeatedly removed and re-inserted therein. It is an object of the present invention to provide an electrical contact having an improved performance under at least some of the above conditions.

Accordingly there is provided an electrical contact for press fitting into a hole, the contact including a compliant section of substantially C-shaped cross-section and comprising first and second arm portions with a base portion therebetween, the thickness of the section increasing steadily from the base portion to the arm portions such that the centre of the base portion is of least thickness to form a hinge about which the first and second arm portions may be preferentially deflected. It is not attempted to distribute the stress uniformly along the arm portions, but conversely the stress is concentrated about the central base portion, which acts as a hinge. As the arms deflect about a single predetermined point, the performance of the compliant section is more controlled.

On insertion of the compliant section into a hole, the base portion is subjected to two opposing forces. Firstly, due to the action of the edges of the hole on the edges of the arm portions, the base portion will be subjected to a compressive force directed from each arm towards the centre of the base portion. Secondly the base portion will be subjected to stretching forces caused by the hinging of the arm portions. These forces will, in combination, produce an increased resilience in the arms of the pin which will produce a firm mechanical and electrical contact between the end of the arm portions and the sides of the hole.

Preferably the rate of change of thickness of the compliant section, from the base portion to the arm portions, is substantially constant. Conveniently the compliant section has smooth, continuous inner and outer curved surfaces. The inner and outer surfaces preferably lie respectively on the surface of first and second imaginary cylinders, the first cylinder being of a smaller diameter than that of the second cylinder, and the centres of the first and second cylinders being spaced one from the other along a diameter of the second cylinder. The inner and outer surfaces of the compliant section are conceivably substantially semi-circular in cross-section.

The invention further resides in a method of making an electrical contact from metal bar or wire stock, or from strip or sheet metal or metal alloy including the steps of coining a defined portion of the bar, wire, sheet or strip to increase its surface area, the coined portion being such that it has a substantially planar first surface and a second surface generally arcuate in cross-section, the arcuate second surface sloping away from the first surface towards the edges of the defined portion to increase its thickness thereat; and folding the defined portion into a substantially C-shaped cross-section, the first surface being the outer surface and the second surface being the inner surface of the C-shaped portion.

The invention further extends to a mounting board including one or more plated mounting apertures in which have been inserted one or more of the above described electrical contacts.

The invention will now be further described, by way of example only, with reference to the accompanying drawings in which.

Figure 3:
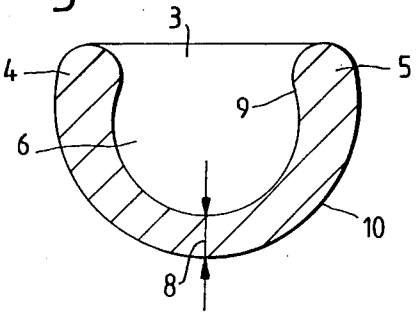
FIG. 3 is a sectional view along the line III—III of FIG. 2.
Figure 4:
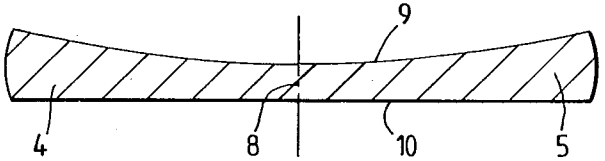

and FIG. 4 is a sectional view of a coined compliant portion prior to forming into the C-shape of FIG. 3.

Figure 1:
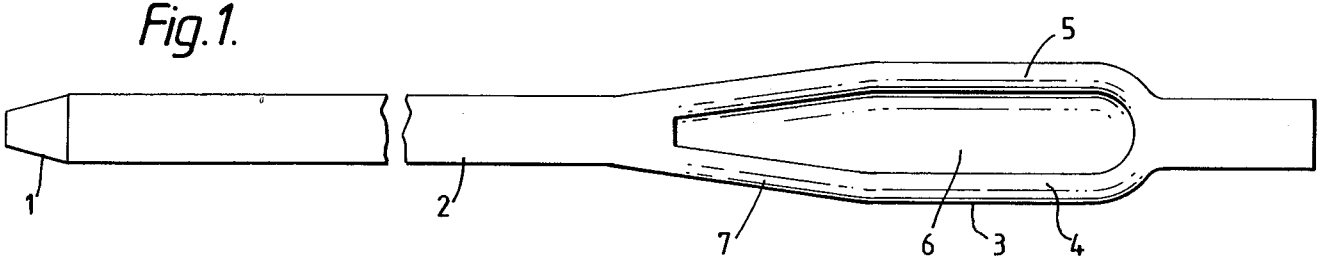
FIGS. 1 and 2 are plan and side views respectively of an electrical contact according to the invention.
Figure 2:
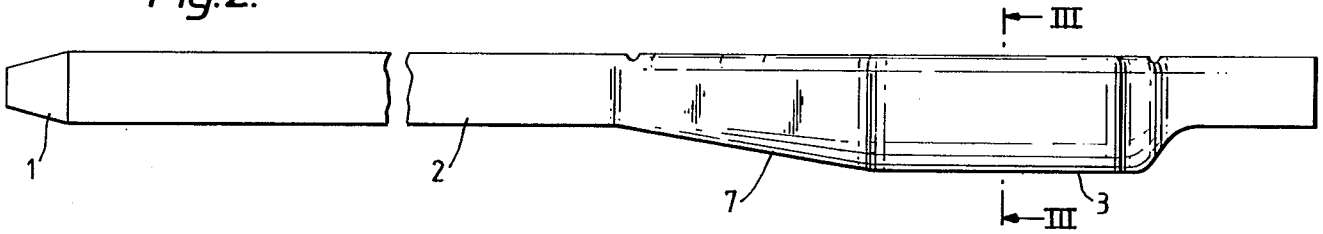

FIGS. 1 and 2 show an electrical contact having a nose portion 1, a barrel portion 2 and a compliant section shown generally at 3. The compliant section 3 comprises two upwardly facing arms 4, 5 with a trough 6 therebetween. A transition section 7, in which the depth of the trough 6 and the distance between the arms decreases, lies between the barrel portion 2 and the compliant section 3.

As shown in FIG. 3 the compliant section 3 is substantially C-shaped. The thickness of the section 3 is least at a central base 8, increasing steadily outwards to the arms 4 and 5. The shape of the section is such that its inner and outer surfaces 9 and 10 respectively define semi-circles, the inner surface 9 being of a smaller radius than that of the outer surface 10, and having a centre displaced downwardly with respect thereto.

In use the electrical contact is inserted into a mounting aperture in a circuit board, the diameter of the aperture being between that of the barrel portion 2 and that of the compliant section 3. On insertion, the arms 4, 5, are deflected inwardly, hinging about the central base 8 of least cross-sectional thickness.

FIG. 4 shows the cross-sectional shape of a compliant section which has been coined but not yet folded into its C-shape. The outer surface 10 is substantially planar, the inner surface 9 being coined into an arcuate shape of relatively large radius. This provides the gradual increase in thickness from the central base 8 to the arms 4 and 5.

I claim:

1. An electrical contact for press fitting into a hole, the contact including a compliant section of substantially C-shaped cross-section, the compliant section comprising first and second arm portions and a base portion therebetween, the structure of the compliant section being such that its thickness increases steadily from the base portion to virtually the extreme ends of the arm portions such that the centre of the base portion is of least thickness to form a hinge about which the first and second arm portions may be preferentially deflected.

2. An electrical contact according to claim 1 wherein the structure of the compliant section is such that its rate of change of thickness, from the base portion to the arm portions, is substantially constant.

3. An electrical contact according to claim 1 wherein the compliant section has smooth, continuous inner and outer curved surfaces.

4. An electrical contact according to claim 3 wherein the inner and outer surfaces of the compliant section lie respectively on the surface of first and second imaginary cylinders, the first cylinder being of a smaller diameter than that of the second cylinder, the centres of the first and second cylinders being spaced one from the other along a diameter of the second cylinder.

5. An electrical contact according to claim 4 wherein the inner and outer surfaces of the compliant section are substantially semi-circular in cross-section.

6. A mounting board including a plated mounting aperture in which has been inserted an electrical contact according to claim 1.

* * * * *